United States Patent [19]

Hill

[11] 4,414,899

[45] Nov. 15, 1983

[54] INK ROLLER ASSEMBLY ATTACHMENT

[75] Inventor: Forrest G. Hill, Belleville, Ill.

[73] Assignee: Marsh Stencil Machine Company, Belleville, Ill.

[21] Appl. No.: 362,609

[22] Filed: Mar. 29, 1982

[51] Int. Cl.[3] ..... B41K 1/22

[52] U.S. Cl. ..... 101/331; 101/349; 101/350; 101/367; 118/259; 118/262

[58] Field of Search ..... 101/205–209, 101/348–352, 328, 329, 367, 330, 331; 29/125; 118/259, 262

[56] References Cited

U.S. PATENT DOCUMENTS

| | | | |
|---|---|---|---|
| 1,139,710 | 5/1915 | Ocumpaugh | 101/348 |
| 1,716,108 | 6/1929 | Brueshaber | 101/348 X |
| 1,816,935 | 8/1931 | Roesen | 101/349 |
| 2,048,366 | 7/1936 | Ball | 101/348 X |
| 2,887,047 | 5/1959 | McKay | 101/329 |
| 2,915,009 | 12/1959 | Chase | 101/349 |
| 3,227,080 | 1/1966 | Hill | 101/350 X |
| 3,654,863 | 4/1972 | Hill et al. | 101/330 X |
| 3,656,677 | 4/1972 | Stepanek et al. | 101/349 X |
| 4,018,156 | 4/1977 | Giordano | 101/349 X |

FOREIGN PATENT DOCUMENTS

| | | | |
|---|---|---|---|
| 1242636 | 6/1967 | Fed. Rep. of Germany | 101/349 |
| 2202417 | 8/1972 | Fed. Rep. of Germany | 101/348 |

*Primary Examiner*—Edgar S. Burr
*Assistant Examiner*—Moshe I. Cohen
*Attorney, Agent, or Firm*—Rogers, Eilers & Howell

[57] ABSTRACT

An ink roller assembly for attachment to a tape printer or the like includes a pre-inked roller rotatably mounted between a pair of hanger brackets of substantially greater diameter and capacity than the standard pre-inked roller included with the machine. The hanger brackets are adapted to mount to an eccentric shaft which can be rotated to finely adjust the pressure of the ink roller against the print wheel. Several cross shafts extend between the hanger brackets to provide support with one of the cross shafts having a threaded hole therein for insertion of a threaded screw against the frame of the machine to adjust the pressure of the oversized ink roller against the print wheel.

6 Claims, 4 Drawing Figures

INK ROLLER ASSEMBLY ATTACHMENT

BACKGROUND AND SUMMARY

There are many machines in use today which utilize a print wheel for printing a message on all sorts of materials, and which utilize a pre-inked roller in rolling contact with the print wheel to apply ink thereto. The inventor herein has himself previously invented several machines using such a print wheel and roller combination. Examples of these are found in U.S. Pat. No. 4,182,645, and U.S. Pat. No. 3,227,080, the disclosures of which are incorporated herein by reference. As shown in these patents, and as is known in the prior art, the roller is generally limited in its size, and hence in its ink capacity, by the physical limitations of the brackets which support it and which also generally support the print wheel. While this is not a significant problem as a pre-inked roller can provide a substantial operating life before it runs low and requires changing, the ink supply is the limiting factor on its useful life. After the ink runs out, the roller must be changed which can be a messy job requiring it to be handled, as well as a freshly inked roller.

To extend the time period between roller changes, and to provide the versatility of multiple colors, the inventor herein is also the inventor of a wick-type cartridge attachment disclosed in U.S. Pat. No. 3,654,863, incorporated herein by reference. The invention disclosed therein includes an auxiliary reservoir of ink with a spring loaded wick extending therefrom and arranged with a pair of hanger brackets to attach to a tape printer or the like. In operation, the wick remains saturated with ink from the reservoir and is urged against the transfer roller to continuously apply ink thereto as it rotates. This invention is a good and valuable invention and significantly extends the time period between ink run-outs, and also permits rapid changeover to a different ink color by simply changing cartridge attachments. As explained therein, replacement of the inking cartridge may be quickly and easily effected by simply unhooking the cartridge from the shaft supporting the transfer roller and replacing it with a fresh cartridge. This completely eliminates the mess of replacing a pre-inked roller.

As an alternative to the pre-inked roller of the prior art or the inking cartridge of U.S. Pat. No. 3,654,863, the inventor herein has succeeded in developing an ink roller assembly for attachment to a tape printer or the like with an enlarged ink roller which may be pre-inked and which replaces the smaller pre-inked roller, or the transfer roller of the other designs. The ink roller attachment is essentially a piggyback unit which is mounted on the back of the tape printer and in place of the roller delivering ink to the print wheel. Moving the roller out from between the machine brackets eliminates the mechanical limitations inherent in the prior art designs and permits the use of a substantially larger roller with a much greater ink capacity. Furthermore, the piggy-back design retains the advantages of the inventor's cartridge attachment including quick color changeover and rapid ink replenishment with little or no mess.

The ink roller attachment includes an oversized roller rotatably mounted between a pair of hanger brackets, with a plurality of cross shafts also extending between the brackets for stability. The hanger brackets have ears for hooking over the eccentric shaft used to mount and align the transfer roller or smaller pre-inked roller of the other designs. Thus, this eccentric shaft provides a fine adjustment of the pressure between the oversized ink roller and the print wheel. One of the cross shafts has a threaded hole with an adjustment screw for insertion therethrough and against the tape printer frame to further urge the roller against the print wheel. This adjustment provides greater potential movement for the position of the ink roller with respect to the print wheel and can thus be viewed as a gross adjustment. Other features and advantages of the present invention may be learned by reviewing the drawings and description of the preferred embodiment which follows.

DETAILED DESCRIPTION OF THE PREFERRED EMBODIMENT

Figure 1:
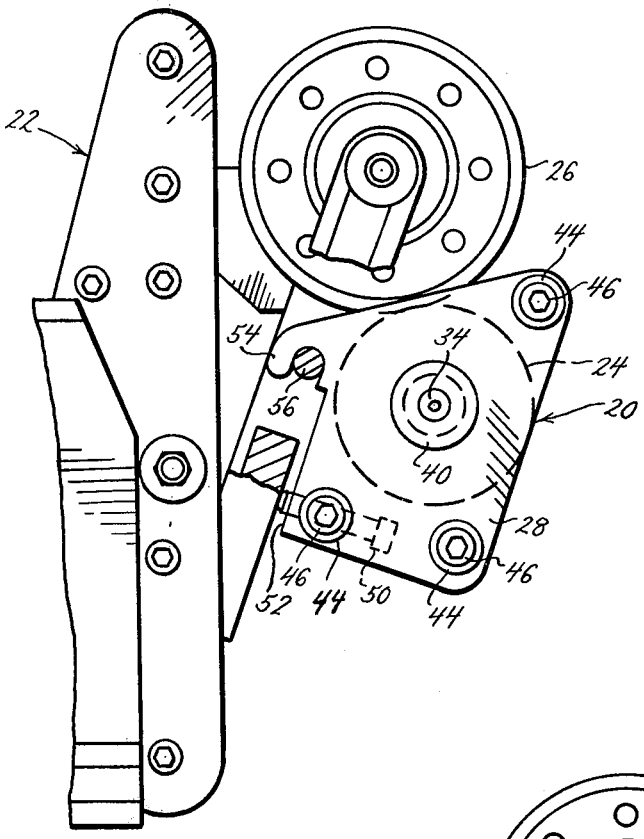
FIG. 1 is a side view of applicant's invention shown mounted to a tape printer or the like with the ink roller contacting the print wheel.
Figure 2:
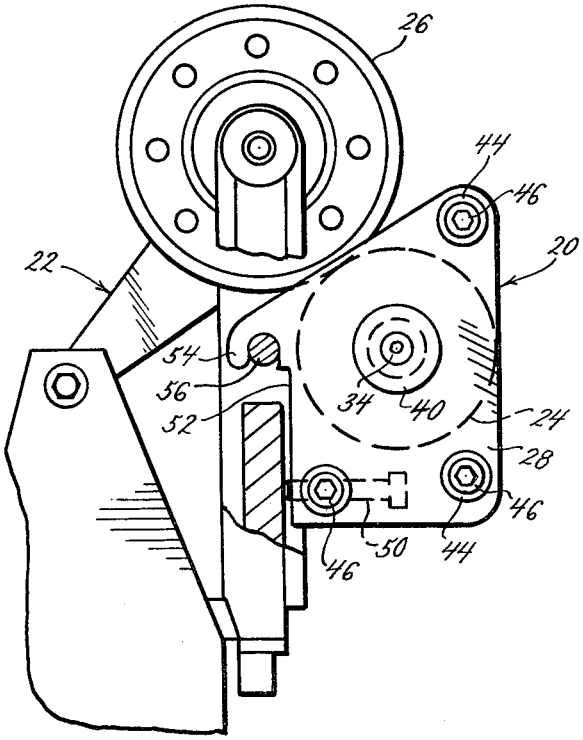
FIG. 2 is a view similar to FIG. 1 except disclosing a different print wheel arrangement.

The ink roller assembly 20 of the present invention is shown in FIGS. 1 and 2 mounted to a tape printer 22 and aligned such that the ink roll 24 is directly contacting the print wheel 26 thereof. Thus, a steady even supply of ink is transferred from ink roller 24 to print wheel 26 as is necessary to ensure reliable operation of the tape printer 22.

Figure 4:
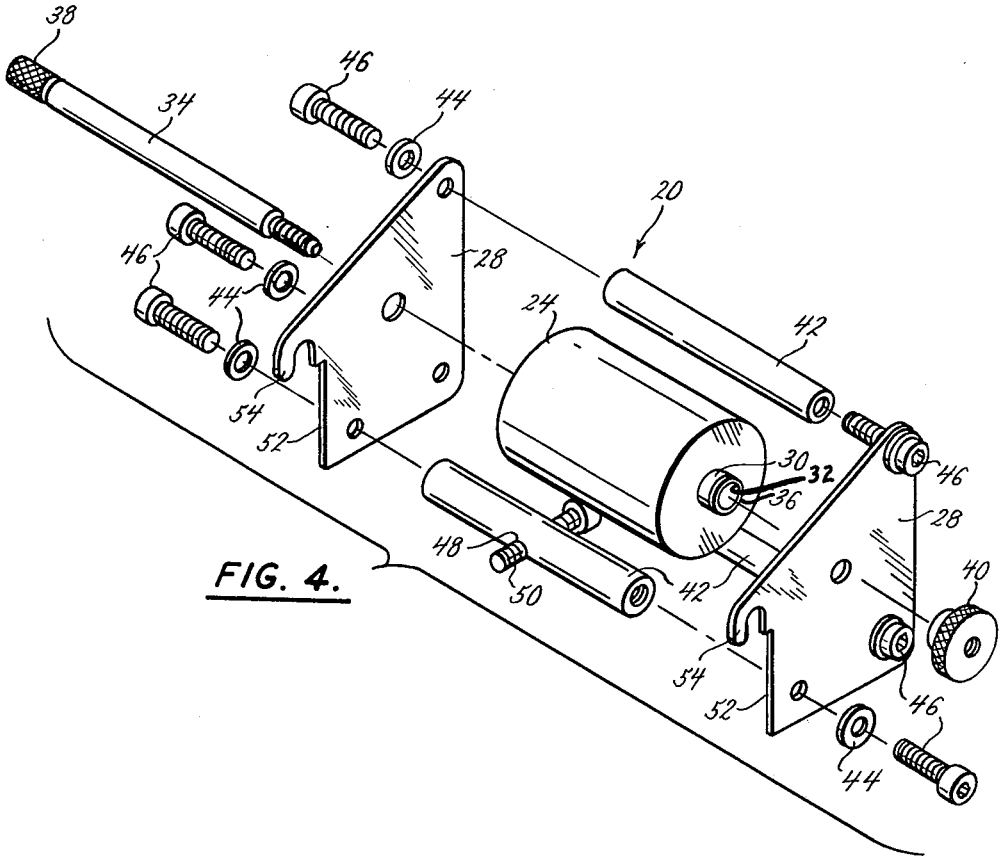
FIG. 4 is an exploded view of applicant's ink roller assembly detailing the various parts included in the assembly.
Figure 3:
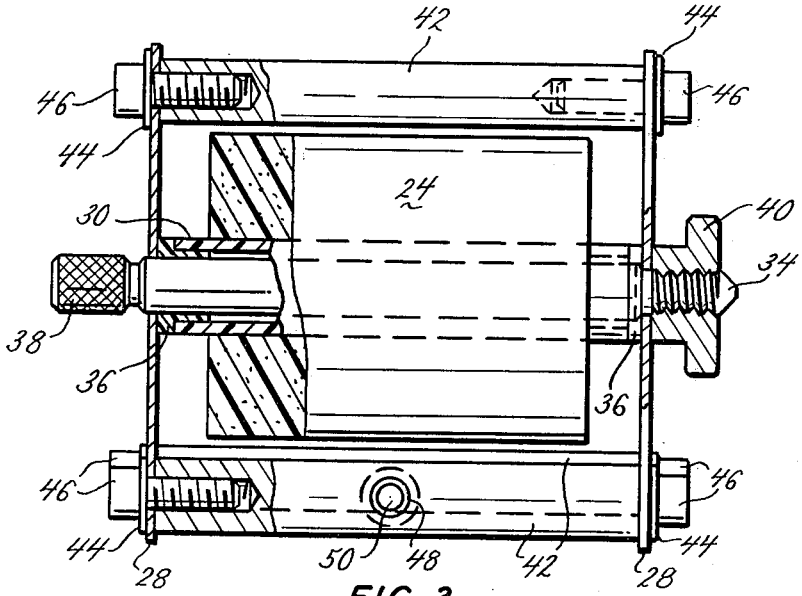
FIG. 3 is a front view of applicant's ink roller assembly with portions broken away to detail mounting of the oversize roller.

Referring to FIGS. 3 and 4, the ink roller assembly 20, in addition to the ink roll 24 includes a pair of hanger brackets 28 which provide the frame work for the assembly 20. The aforementioned ink roll 24 has an inner core 30 which extends through the axial hole 32 and which may be made of PVC or the like to keep shaft 34 relatively free of ink. A pair of end sleeves 36 are pressure fit into each end of core 30 and act as bearings between the roll 24 and shaft 34. Shaft 34 has a knurled knob 38 at an end thereof which extends beyond hanger bracket 28 to aid in tightening knurled nut 40 to shaft 34 to rotatably mount the ink roll 24 between hanger brackets 28. One or more cross shafts 42 mount to and extend between hanger brackets 28 to stabilize the assembly 20. One or more washers 44 and bolts 46 are used to secure these shafts to prevent their working loose during use. The cross shaft 42 closest to the front of hanger brackets 28 has a threaded hole 48 and matching screw 50 aligned to extend generally perpendicularly to the front face 52 of hanger brackets 28. As shown in FIGS. 1 and 2, screw 50 may be easily adjusted to fix the position of ink roll 24 against print wheel 26, in addition to that adjustment described below.

Referring again to FIGS. 1 and 2, the hanger brackets 28 have hook members 54 which are adapted to hook around the eccentric mounting shaft 56 for the transfer roller (not shown) provided as part of the existing tape printer 22. As is apparent from the foregoing description, the ink roller assembly 20 may be easily installed on a tape printer 22 such as that shown in FIGS. 1 and 2 by merely loosening the lock nut securing eccentric shaft 56 to the tape printer frame, removing eccentric shaft 56 and the transfer roller mounted thereon, replacing the eccentric shaft 56, and hanging the ink roller assembly 20 of the present invention around the ends of eccentric shaft 56. Before installing ink roller assembly 20, care should be taken to see that adjustment screw 50 has been backed out of hole 48 to prevent interference with the tape printer frame. Once installed, the position of ink roll 24 with respect to print wheel 26, and hence the pressure between them, may be adjusted in either or both of two ways. Firstly, the adjusting screw 50 may be tightened down against the tape printer frame to pivot the hook members 54 about eccentric shaft 56 and thus bring ink roll 24 into contact with print wheel 26. Secondly, eccentric shaft 56 may be loosened and rotated to lift the entire ink roll assembly 20 against the print wheel 26, much as is disclosed in connection with the transfer roll and ink cartridge design of U.S. Pat. No. 3,654,863. Although the adjusting screw 50 provides a greater range of adjustment, and hence can be viewed as a gross adjustment, either technique can be used singly or in combination, as desired. Some machines might require both adjustments, although the majority may be handled with either.

Various changes and modifications may be made to this invention and are included in the teaching of this disclosure. This invention is limited only by the scope of the claims appended hereto.

I claim:

1. An ink roller assembly for attachment to a tape printer or the like to replace the transfer roller thereof, the tape printer having a print wheel and a transfer roller in operational contact with the print wheel to apply ink thereto, said transfer roller being axially mounted on a shaft, the ink roller assembly replacing the transfer roller in the tape printer and having a pair of hanger brackets for suspending the ink roller assembly from the transfer roller shaft of the tape printer when said transfer roller has been removed, said ink roller assembly further including a pre-inked roller rotatably mounted on a shaft, said shaft being mounted solely to and between said hanger brackets, and said ink roller assembly having means to urge the ink roller against the print wheel when said ink roller assembly is mounted, said ink roller assembly thereby replacing the transfer roller.

2. The ink roller assembly of claim 1 wherein the shaft rotatably mounting the tape printer transfer roller to the tape printer is eccentric, the ink roller assembly hanger brackets having hook members adapted to hook over said eccentric shaft and means to rotate and fix said eccentric shaft to thereby bring the ink roller assembly roller into contact with the print wheel and fix said ink roller assembly roller in said contacting orientation.

3. The ink roller assembly of claim 1 wherein the pre-inked roller of the ink roller assembly has a substantially greater diameter than the transfer roller.

4. The ink roller assembly of claim 1 further comprising at least one cross bar extending between the hanger brackets, and wherein the urging means comprises means defining a threaded hole extending through said cross bar, and a threaded screw having a shank substantially greater than the length of said hole, said hole being aligned so that insertion of the screw through the hole brings it into contact with the tape printer.

5. The ink roller assembly of claim 4 wherein said shaft rotatably mounting the ink roller is removable, said ink roller being replaceable by removing said shaft.

6. The ink roller assembly of claim 4 wherein the shaft rotatably mounting the tape printer transfer roller to the tape printer is eccentric, the ink roller assembly hanger brackets having hook members adapted to hook over said eccentric shaft and means to rotate and fix said eccentric shaft to thereby bring the ink roller assembly roller into contact with the print wheel and fix said ink roller assembly roller in said contacting orientation.

* * * * *